US005972286A

United States Patent [19]

Lenk et al.

[11] Patent Number: 5,972,286

[45] Date of Patent: Oct. 26, 1999

[54] PROCESS FOR MANUFACTURING HARD METAL PARTS

[75] Inventors: Reinhard Lenk, Coswig; Claus Richter, Meissen; Waldemar Hermel, Dresden, all of Germany

[73] Assignee: Fraunhofer-Gesellschaft Zur Forderung Der Angewandten Forschung E.V., munich, Germany

[21] Appl. No.: 09/091,096

[22] PCT Filed: Dec. 5, 1996

[86] PCT No.: PCT/EP96/05452

§ 371 Date: Jun. 26, 1998

§ 102(e) Date: Jun. 26, 1998

[87] PCT Pub. No.: WO97/22427

PCT Pub. Date: Jun. 26, 1997

[30] Foreign Application Priority Data

Dec. 15, 1995 [DE] Germany ..... 195 46 901

[51] Int. Cl.[6] ..... B22F 3/00

[52] U.S. Cl. ..... 419/23; 419/14; 419/40; 264/478; 264/645; 264/651; 264/656; 264/669

[58] Field of Search ..... 419/23, 14, 40; 264/478, 645, 651, 656, 669

[56] References Cited

U.S. PATENT DOCUMENTS

| | | | |
|---|---|---|---|
| 3,351,688 | 11/1967 | Kingery et al. | 264/656 |
| 3,416,905 | 12/1968 | Waugh | 51/296 |
| 4,011,291 | 3/1977 | Curry | 264/43 |
| 4,094,061 | 6/1978 | Gupta et al. | 29/612 |
| 4,338,272 | 7/1982 | Pelton et al. | 264/86 |
| 4,708,838 | 11/1987 | Bandyopadhyay et al. | 264/63 |
| 5,059,387 | 10/1991 | Brasel | 419/23 |
| 5,328,657 | 7/1994 | Kamel et al. | 419/36 |

*Primary Examiner*—Ngoclan Mai

*Attorney, Agent, or Firm*—Greenblum & Bernstein, P.L.C.

[57] ABSTRACT

The invention relates to the field of ceramic and hard metal industries and concerns a process for manufacturing hard metal parts, in particular those having a complex geometry, such as those used for example as machining tools and wear elements. The object of the invention is to create a process which allows the manufacture of hard metal parts with a complex geometry by using a stable dispersed hard metal-binder suspension, wherein the binder is a thermoplastic binder having a viscosity of 3 to 6 mPa s, and without using an organic solvent to eliminate the binder. For that purpose, a process is disclosed wherein a hard metal powder having an average grain size smaller than 2.0 $\mu$m is mixed with a liquefied thermoplastic binder, with viscosity of the mixture being set upon a value of at least 100 mPa s and up to 4,000 mPa s during the whole production and treatment process. The thus obtained stable dispersed suspension is shaped into a molded body from which the thermoplastic binder is then expelled and the binder-free shaped body is then sintered.

20 Claims, No Drawings

PROCESS FOR MANUFACTURING HARD METAL PARTS

BACKGROUND OF THE INVENTION

1. Field of the Invention

The invention refers to the field of ceramics and hard metal industry and relates to a process for the manufacture of hard metal component parts, in particular with complicated geometries, as they are for example used in machining tools and wear units.

2. Discussion of Background Information

Ceramic and powder metal parts with complicated geometries can be manufactured by performing mechanical reworking of the outer contours, beginning from raw bodies. With such materials, it is possible to execute the reworking process in a shaped state, a sintered state, or a state in between these two procedural steps. The cost of processing increases with the hardness of the material in its respective state, with the complexity of the geometry, and the number of pieces.

Large numbers of parts, composed of powder-technological or ceramic materials, are manufactured economically with the aid of end-for-like ("near net shape") thermoplastic casting processes. The injection molding of powder metal and ceramic is known, which is based on the mixing of a non-plastic powder with a thermoplastic synthetic binding agent and the occurrence of an injection molding mass, able to flow at higher temperatures and pressure, which can be processed in conventional synthetic material injection molding machines (U.S. Pat. No. 2,122,960, DE 680250).

Also known is a thermoplastic molding process that is based on the liquidization of non-plastic ceramic powders with the aid of paraffins and waxes. The molding process of thermoplastic suspensions is already possible at low pressures (SU 137807). The process is called hot casting or low pressure injection molding. Different ceramic materials, such as aluminum oxide, zirconium oxide, silicon carbide, have already been processed with this process. The material-specific characteristics are primarily based on the displacement of the thermoplastic binding agents that each consist of surface-active materials for the modification of the powder surface (SU 298566, SU 298567, DD 139397, DD 233117, DD 233119, SU 1590468). Concepts for a machine to realize the molding process are known (U.S. Pat. No. 4,416,603, DD 281913). An overview of the hot casting process is also published (Lenk, R., *Technische Keramische Werkstoffe*, Chapter 3.4.8.1).

Furthermore, from DD 286 311, a process is known for the manufacture of molded parts made of sintered materials using an injection molding process, whereby a plasticized mass is manufactured from a pre-treated metal powder and an organic binding agent and is then processed into molded parts after the removal of the binding agent using a subsequent injection molding process, and afterwards undergoes a sintering process. The binding agent consists of paraffin and polyethylene wax.

The powder-metallurgical injection mold process of heavy duty materials is furthermore known from Dropmann, et. al., *Metall*, vol. 45, no. 5, May 1991. The used binding agents thereby in essence determine whether or not an injection molding of the mass or a complete mold filling is possible. The viscosity of the masses thereby have a particular significance. Injection mold masses with a viscosity <4000 mPa s are thereby not able to be used.

Up to now it was not possible to process hard metal materials with the hot casting process, since no stable, dispersed thermoplastic suspension could be produced due to the low viscosity of the thermoplastic binding agent (3 to 6 mPa s) and the high density difference between the hard metal powder and the used binding agent (12 to 14 fold). However, the manufacture of such stable, dispersed thermoplastic suspensions is the prerequisite for the manufacture of foundations with reproducible homogeneity and density, and thereby for the transformation to serial production.

Hard metal component parts with complex geometries, even with larger numbers, essentially have, until now, been manufactured with an expensive mechanical reworking in the sintered state.

In the last couple of years an injection molding technology has been developed that combines the possibilities of large-scale fabrication with the advantages of reproducing very complex geometries (DE 3808123.7). In order to minimize the problems of this process, resulting from the high density differences between the powder and the binding agent as well as from the very high flow velocities during the form filling process (segregation of mixtures and separation), synthetic material binding agents with higher viscosity are used. These temporary synthetic binding materials are expelled by extraction in a closed release process, with the aid of organic solvents before the component parts are sintered (Graf, W, et. al., *Pulvermetall in Wissenschaft und Praxis*, vol. 7, VDI-Verlag, Düsseldorf, 1991, pp.275–285).

The limits of this process lie in a complicated process sequence, high equipment costs that only amortize with a very large number of pieces, and the difficulty of using large quantities of organic solvents because of environmental issues.

SUMMARY OF THE INVENTION

The aim of the invention consists of stating a process for manufacturing hard metal component parts, in which hard metal parts with complex geometries can be fabricated by using a stable, dispersed hard-metal-binding-agent suspension with a thermoplastic binding agent exhibiting a viscosity of 3 to 6 mPa s, and without using organic solvents for the release process.

In a process for manufacturing hard metal component parts in accordance with the invention, a hard metal powder with an average grain size <2.0 $\mu$m is mixed with a liquefied thermoplastic binding agent, whereby the viscosity of the mixture during the entire manufacturing process and the processing is adjusted to a value of at least 100 mPa s and to <4000 mPa s, and the resulting stable, dispersed suspension is worked into a mold shape from which the thermoplastic binding agent is extracted thereafter, and the released mold shape is then sintered.

Paraffins, waxes, and surface-active additives are preferably used as thermoplastic binding agents.

Hard materials WC, TaC, NbC, VC, TiC, $Mo_2C$, Co, Ni or mixtures of these hard materials are preferably used in powder form.

Hard material powders with an average grain size of 0.5 to 1.5 $\mu$m are also preferably used.

It is also advantageous to adjust the viscosity of the mixture of hard metal powder and the liquefied thermoplastic binding agent during the entire manufacturing process and processing to a value between 100 to 2000 mPa s.

It is furthermore advantageous to add the hard metal powder to the liquid thermoplastic binding agent in several steps.

With the aid of the process in accordance with the invention, it becomes possible to manufacture a stable, dispersed mixture, consisting of the hard material and the thermoplastic binding agent, that can then be processed into a mold shape using a hot casting (low pressure injection molding).

Elaborate post-processing steps of hard metal component parts is avoided in each state of the manufacturing process and neither high technical efforts, as required when using highly viscous binding agents, nor large amounts of organic solvents have to be used for the release process.

With the aid of the process in accordance with the invention, stable, dispersed suspensions can be achieved even with the large density differences between the hard material powder and the binding agent. The primary particles in the suspension are stabilized and a sedimentation, and thus the loss in homogeneity of the mixture, is avoided.

DETAILED DESCRIPTION OF THE PREFERRED EMBODIMENT OF THE INVENTION

The following describes the invention using an exemplary embodiment.

EXAMPLE 500 g of a hard powder mixtures, consisting of 16.6 weight % Co, 87.8 weight % WC, and 1.6 weight % TaC, NbC, VC with an average grain size of 0.9 $\mu$m are worked into a slurry (suspension) with a thermoplastic binding agent, consisting of 25 g paraffin and 5 g stearic acid in the following manner.

The binding agent constituents paraffin and stearic acid are melted in a heated stirrer vessel at 80° C. and 300 g of the hard metal powder is added. This mixture is stirred intensively. Since the viscosity of the mixture is reduced significantly during the stirring, an additional 100 g of the hard metal powder mixture is added to the mixture when the viscosity drops below 100 mPa s. This results in an immediate increase in the viscosity of the mixture while maintaining the sedimentation stability of the slurry. After another intensive stirring cycle, the remaining 100 g of hard metal powder are added and continuously stirred.

The slurry produced in this manner is fed from a storage reservoir, pressurized with a pressure of 0.6 MPa, over a pipe network into a closed mold with the negative component part mold exhibiting a complex geometry. After the slurry cools, the mold is opened, the component part is released in inert gas by a gradual temperature increase to 300° C. and afterwards sintered at 1450° C.

What is claimed is:

1. A process for manufacturing hard metal component parts, comprising:

mixing hard metal powder having an average grain size less than 2.0 $\mu$m with liquefied thermoplastic binding agent to form a stable, dispersed suspension having a viscosity of at least 100 mPa s to less than 4,000 mPa s;

processing said suspension having a viscosity of at least 100 mPa s to less than 4,000 mPa s into a molded body;

expelling said thermoplastic binding agent from said molded body; and sintering said molded body.

2. The process according to claim 1, wherein the thermoplastic binding agent comprises at least one member selected from the group consisting of paraffins, waxes, and surface-active additives.

3. The process according to claim 2, wherein the hard metal powder comprises at least one member selected from the group consisting of WC, TaC, NbC, VC, TiC, $Mo_2C$, Co and Ni.

4. The process according to claim 1, wherein the hard metal powder comprises at least one member selected from the group consisting of WC, TaC, NbC, VC, TiC, $Mo_2C$, Co and Ni.

5. The process according to claim 1, wherein the hard metal powder has an average grain size of 0.5 to 1.5 $\mu$m.

6. The process according to claim 3, wherein the hard metal powder has an average grain size of 0.5 to 1.5 $\mu$m.

7. The process according to claim 4, wherein the hard metal powder has an average grain size of 0.5 to 1.5 $\mu$m.

8. The process according to claim 1, wherein the suspension has a viscosity of 100 mPas to 2,000 mPa s.

9. The process according to claim 5, wherein the suspension has a viscosity of 100 mPas to 2,000 mPa s.

10. The process according to claim 6, wherein the suspension has a viscosity of 100 mPas to 2,000 mPa s.

11. The process according to claim 7, wherein the suspension has a viscosity of 100 mPas to 2,000 mPa s.

12. The process according to claim 1, wherein the hard metal powder is mixed with the liquified thermoplastic binding agent in several steps.

13. The process according to claim 8, wherein the hard metal powder is mixed with the liquified thermoplastic binding agent in several steps.

14. The process according to claim 9, wherein the hard metal powder is mixed with the liquified thermoplastic binding agent in several steps.

15. The process according to claim 10, wherein the hard metal powder is mixed with the liquified thermoplastic binding agent in several steps.

16. The process according to claim 11, wherein the hard metal powder is mixed with the liquified thermoplastic binding agent in several steps.

17. The process according to claim 1, wherein the thermoplastic binder has a viscosity of 3 to 8 mPa s.

18. The process according to claim 8, wherein the thermoplastic binder has a viscosity of 3 to 8 mPa s.

19. The process according to claim 9, wherein the thermoplastic binder has a viscosity of 3 to 8 mPa s.

20. The process according to claim 16, wherein the thermoplastic binder has a viscosity of 3 to 8 mPa s.

* * * * *